United States Patent [19]

Smith

[11] Patent Number: 4,767,393

[45] Date of Patent: Aug. 30, 1988

[54] HIGH SPEED PLATEN-TYPE DIE CUTTER

[76] Inventor: Edwin K. Smith, 330 Lake Shore Dr., Haworth, N.J. 07641

[21] Appl. No.: 939,114

[22] Filed: Dec. 8, 1986

Related U.S. Application Data

[63] Continuation of Ser. No. 516,289, Jul. 22, 1983, abandoned.

[51] Int. Cl.[4] ..... B31B 1/20; B31B 1/25

[52] U.S. Cl. ..... 493/342; 493/60; 493/61; 493/355; 493/370; 493/372; 83/92; 83/321

[58] Field of Search ..... 493/56, 59, 60, 61, 493/62, 73, 82, 161, 342, 370, 372, 472; 83/92, 321

[56] References Cited

U.S. PATENT DOCUMENTS

| | | | |
|---|---|---|---|
| 2,406,808 | 9/1946 | Conner | 83/29 |
| 2,407,254 | 9/1946 | Conner | 83/321 |
| 3,203,288 | 8/1965 | Blumer | 83/92 |
| 3,269,245 | 8/1966 | Elineau | 83/305 |
| 3,459,086 | 8/1969 | Goettsch | 493/342 |
| 3,618,437 | 11/1971 | Cocinet et al. | 83/321 |
| 3,784,070 | 1/1974 | Vossen | 493/342 |
| 3,807,610 | 4/1974 | Mueller, Jr. | 493/342 |
| 4,015,495 | 4/1977 | Yerly | 83/103 |
| 4,026,199 | 5/1977 | Adams et al. | 493/342 |

FOREIGN PATENT DOCUMENTS

| | | | |
|---|---|---|---|
| 1038890 | 8/1966 | United Kingdom | 493/340 |
| 1304126 | 1/1973 | United Kingdom . | |
| 2049530 | 12/1980 | United Kingdom . | |
| 2078593 | 1/1982 | United Kingdom | 493/340 |
| 2078591 | 1/1982 | United Kingdom . | |
| 2078593 | 5/1982 | United Kingdom | 493/340 |
| 2099745 | 12/1982 | United Kingdom . | |

*Primary Examiner*—Frederick R. Schmidt
*Assistant Examiner*—William E. Terrell
*Attorney, Agent, or Firm*—Saidman, Sterne, Kessler & Goldstein

[57] ABSTRACT

A flat platen-type cutting and creasing press for sheet material includes a continuously moving closed loop conveyor that carries sheet gripping means in a feed direction along a generally horizontal feed path extending through a sheet loading station, a sheet unloading station, and a cutting station having die elements positioned thereat with the cutting station being positioned between the sheet loading and unloading stations. Eccentric shafts rotating at uniform speed translates platens carrying the die elements along a circular path positioned for the die elements to operatively engage and thereby fully cut a sheet moving along the feed path through said cutting station. Rotating counterbalancing weights on the eccentric shafts are disposed between points on the platens that are connected to the eccentric shafts.

19 Claims, 3 Drawing Sheets

HIGH SPEED PLATEN-TYPE DIE CUTTER

This application is a continuation of application Ser. No. 516,289, filed July 22, 1983 now abandoned.

This invention relates generally to a high speed die cutters, and relates more particularly to a platen-type die cutter wherein sheets move continuously at uniform speed.

High speed die cutting of corrugated board and the like is usually done by either rotary or platen-type machines. In a rotary machine, sheets move continuously between a pair of rotating cylinders, one of which carries curved cutting and creasing dies and also carries stripping elements which eject scrap as cutting takes place. For the most part, platen-type machines are constructed so that the sheets are advanced successively through cutting, stripping and delivery stations, being carried by intermittently advancing chain carried gripper bars. Rotary machines operate at much higher production rates than platen machines since the former do not require the starting and stopping of sheets as they move through the machine. However, platen-type machines are required for high precision work and are desirable in that the curved dies required of rotary machines are much more expensive than the flat dies utilized by platen machines. Further, flat die cuts are cleaner and non-serrated because cutting is against steel instead of against a soft rotary anvil. In platen die cutters stripping is more complete in that there may be included a separate stripping station having male and female dies.

The prior art has attempted to speed up operation of platen-type machines by moving the chain carried gripper bars continuously so that cutting and creasing takes place while the sheet is moving through the machine. However, in this type of prior art machine described in U.S. Pat. No. 3,203,288, issued Aug. 31, 1965, to H. Blumer for a "Machine for Cutting and/or Creasing Sheets of Thin Materials Such As Paper and Cardboard and Metal or Plastic Foils", even though the sheet was not brought to a complete stop at the cutting, stripping, delivery, etc. stations, the sheet was slowed down substantially at these locations. High speed sheet travel took place only between stations.

This slowing down of the sheets reduced production rates. In addition, the sheets were accelerated rapidly from slow to high speed, generating high machine forces which increased wear. Rapid acceleration placed additional strain on the connecting points or "nicks" between the leading edge trim strip held by the grippers and the useful portions of the cut and creased sheet, as well as between nicks connecting multiple items on one sheet. Because of this, the nicks were required to be so heavy as to be unsightly and make it difficult to separate the trim strip from the remainder of the cut sheet, or to separate die cut items from each other.

Other examples of prior art high speed platen-type die cutters are disclosed in U.K. Patent Application Nos. GB 2 078 593A and GB 2 085 791A. In these prior art die cutters the anvil is curved to obtain a moving line cut rather than being flat to obtain a full cut. Utilizing a line cut requires an increase in cutting time as compared to a full cut. A line cut requires the use of a more complicated, less durable crank and slide-link mechanism to synchronize drive of the die platen and anvil.

In order to obtain high production yet retain the advantages of a platen-type cutting and creasing press over a rotary-type machine, the instant invention provides a platen-type construction in which sheets move continuously at uniform speed through the machine and eccentrics are used to drive the die and anvil platens to achieve a full cut.

Accordingly, the primary object of the instant invention is to provide an improved platen-type cutting and creasing press which obtains high rates of production by utilizing constant velocity motion of both machine parts and sheets being cut thereby.

Another object is to provide a platen-type cutting and creasing press constructed so as to permit the use of relatively narrow "nicks" for connecting the lead edge trim strip to the remainder of the cut and creased sheet, and connecting die cut items to each other.

Still another object is to provide a platen-type cutting and creasing press in which sheets move through the machine at a uniform speed.

A further object is to provide a platen-type cutting and creasing press in which the feed slats or gripper bars are not stopped or slowed down at the sheet receiving station.

A still further object is to provide a high speed full cut platen-type cutting and creasing press in which the platens are driven solely by eccentric shafts.

These objects as well as other objects of this invention shall become readily apparent after reading the following description of the accompanying drawings in which:

FIG. 5 is a fragmentary plan view, in schematic form, illustrating means for operating the movable sheet supporting slats.

Figure 1:
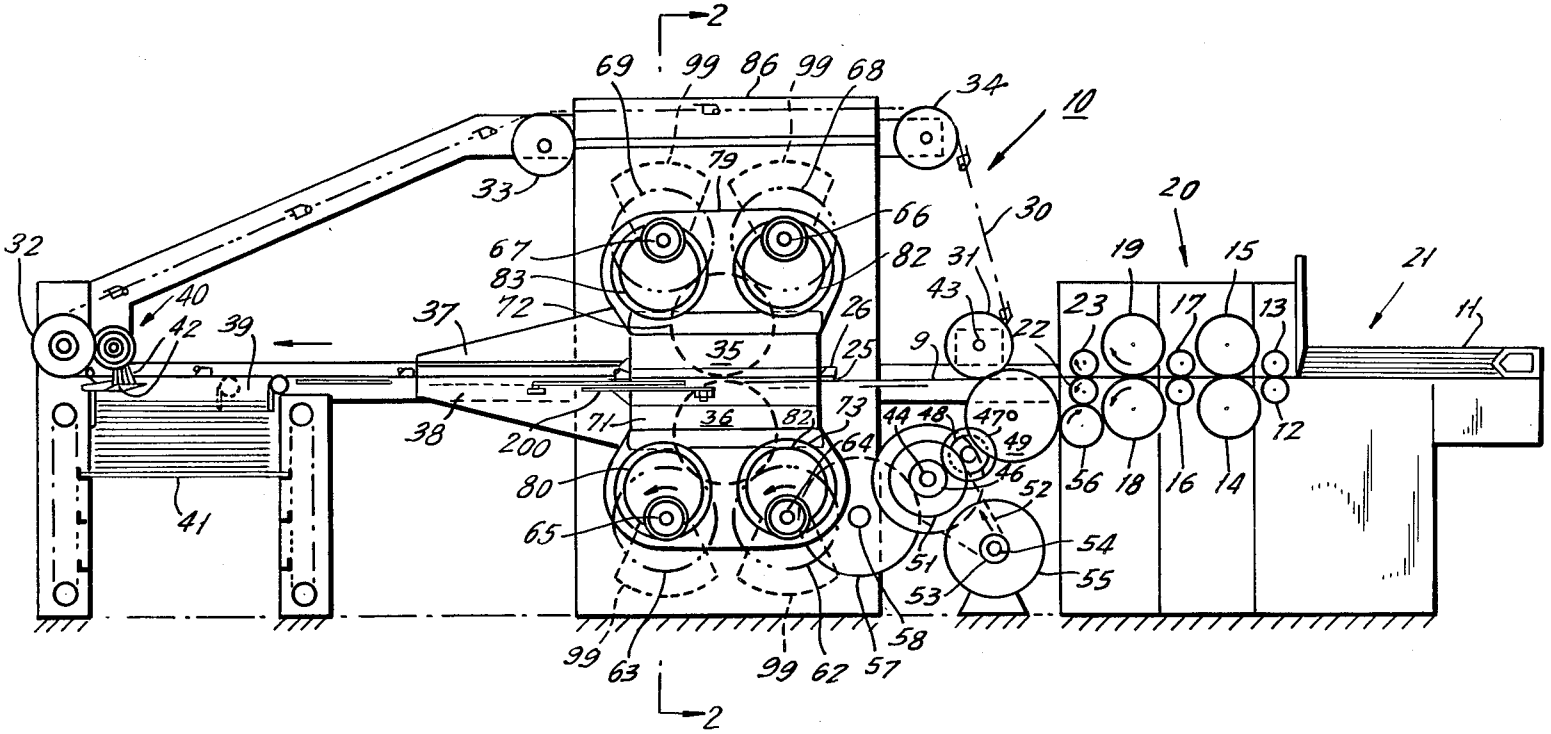
FIG. 1 is a side elevation of a platen-type cutting and creasing press constructed in accordance with teachings of the instant invention.

Now referring to the Figures. Cutting and creasing press constructed in accordance with the teachings of the instant invention, indicated generally by reference numeral 10 in FIG. 1, receives corrugated sheets 9 fed forward (to the left wih respect to FIG. 1) one at a time from the bottom of pile 11 in hopper 21 of sheet feeder 20 having a conventional reciprocating feed slat (not shown). Immediately after leaving hopper 21 each sheet 19 is engaged and moved by opposed pairs of feed rolls 12–13, 14–15, 16–17, 18–19, 22–23 which deliver each sheet to a plurality of grippers 25 spaced along the length of transverse feed slat 26. As will be hereinafter explained, feed slat 26 is secured to endless chain 30. In reality, chain 30 is two parallel chains secured to opposite ends of feed slat 26. In a manner well known to the art, chain 30 carries a plurality of feed slats 26 equally spaced along the length of chain 30 and extending transverse to the vertical plane in which chain 30 moves. The path of chain 30 is defined by four sprockets 31–34.

The lower or main horizontal run of chain 30 is between sprockets 31 and 32, enabling feed slat 26 to carry a sheet 9 between cutting platens 35, 36 for the die and anvil, then between stripping platens 37, 38 to a delivery or unloading station in a position above receiver 39 wherein the sheets are accumulated into piles 41. Rotary drum device 40 disposed immediately upstream of sprocket 32 is provided with pre-set punches or fingers 42, or with an equivalent die strip (not shown), which engage the cut and creased box, tray, or the like, to separate the latter from the leading edge trim strip held by grippers 25. At a location in the vicinity of sprocket 33 grippers 25 open and the lead edge trim strip is removed in a manner well known to the art. Sprocket 31 is keyed to shaft 43 driven by shaft 44 through gear train 46–49 and a gear (not shown) keyed to shaft 43. Shaft 44 is keyed to gear 51 driven by belts 52 through pulley 53 keyed to output shaft 54 of motor 55. The latter also drives sheet feeder 20 through a gear train which includes gear 49, gear 56 and a gear keyed to the shaft for feed roll 18.

Motor 55 also drives platens 35, 36 toward and away from the main horizontal sheet feed path between sprockets 31, 32. More particularly, gear 46 drives gear 57 keyed to shaft 58. The latter is keyed to a small gear in engagement with large gear 62 keyed to rotatable fixed axis shaft 64 which provides one of the supports for lower platen 36. The other supporting rotatable fixed axis shaft 65 for lower platen 36 is keyed to gear 63 of the same size as gear 62. Similarly, upper platen 35 is supported by rotatable fixed axis shafts 66, 67 keyed to the respective gears 68, 69 of the same size as gears 62, 63. The driving connections between all four gears 62, 63, 67, 68 is through intermeshing gears 71, 72. The former 71 directly engages gears 62, 63 and the latter 72 directly engages gears 68, 69.

Movement of platens 35, 36 is controlled by an eccentric means comprising eccentrically rotated discs 73, 80, 82, 83 and associated elements. More particularly, interposed between shaft 64 and lower platen 36 is disc 73 eccentrically keyed to shaft 64 and having its periphery engaged by bearing 75 (FIG. 2) secured in downward extension 76 of lower platen 36. For purposes of reducing moments of force tending to bend shaft 64, platen 36 is provided with two transversely spaced downward extensions 76 through which shaft 64 extends. Extensions 76 are positioned considerably inboard of the side edges of lower platen 36. Similarly, another pair of eccentric discs 80 is keyed to the other lower shaft 65 and rides in bearings mounted to downward extensions 76. Thus, as shafts 64, 65 rotate, lower platen 36 translates in a circular path, yet the flat anvil top of platen 36 remains horizontal.

The mounting of upper platen 35 to upper shafts 66, 67 is essentially the same as the mounting of lower platen 36 to lower shafts 64, 65. That is, upper platen 35 is provided with a pair of spaced parallel upward extensions 79 having four bearings 81 rotatably supporting the peripheries of two pairs of discs 82, 83 which are eccentrically mounted on the respective shafts 66, 67. As shafts 66, 67 rotate, upper platen 35 will translate in motion a circular path which maintains the lower die carrying surface of platen 35 in a horizontal plane.

Bearings 84 mounted to spaced parallel stationary frame members 85, 86 rotatably support shafts 64–67. Keyed to each of these shafts 64–67 are sector-like weights 99 for counterbalancing the vertical components of motion imparted to platens 35, 36, as well as the rotating radial centrifugal forces of platens 35, 36 and their supports. Weights 99 on shafts 66, 67 are located between upward extensions 79, 79 and weights 99 on shafts 64, 65 are located between downward extensions 76, 76.

Figure 2:
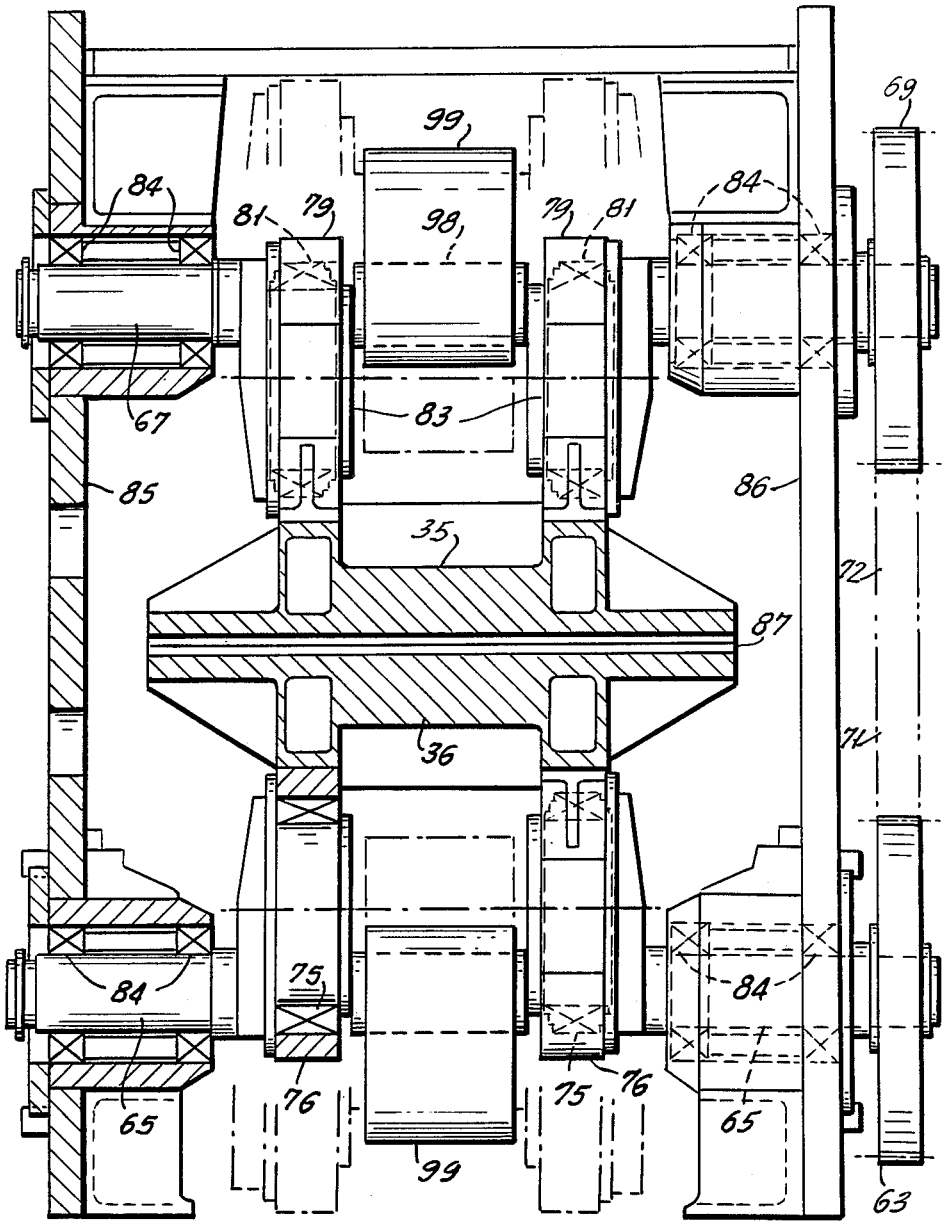
FIG. 2 is a cross-section taken through line 2—2 of FIG. 1, looking in the direction of arrows 2—2.

As seen clearly in FIG. 2, transverse shaft 67 consists of three axially aligned sections, the center section 98 mounting a counterbalance weight 99 and the outer sections being rotatably supported in bearings 84 mounted to side frames 85, 86. An individual disk 83 is eccentrically mounted to each end of end section 98 and to the inboard end of an outer section of shaft 67. The multi-piece construction of shaft 67 and elements mounted thereto is also true of shafts 64–66. This multi-piece construction facilitates fabrication of these parts and their assembly to platens 35, 36.

Thus, it is seen that the motion of upper platen 35 as viewed in FIG. 1 is clockwise, while the rotary motion of lower platen 36 is counterclockwise. Further, platens 35, 36 will move toward the sheet feed path at the same time and will move away from the sheet feed path at the same time. In moving toward the sheet feed path, platens 35, 36 move from right to left with respect to FIG. 1 or in the sheet feeding direction. Chain 30 will so position each sheet 9 that when feed slat 26 is positioned at the left of platens 35, 36, the latter will be moving toward the left with respect to FIG. 1 at essentially the same speed as sheet 9. As this motion continues, platens 35, 36 move toward the sheet feed path with lower platen 36 supporting sheet 9 from below and the flat cutting and creasing dies 87 carried by upper platen 35 operatively engaging sheet 9 to perform the intended cutting and creasing process. As platens 35, 36 separate, they move generally to the left with respect to FIG. 1 and then move to the right.

Secured to cutting platens 35, 36 and extending downstream thereof are stripping platens 37, 38 which have the same motion as platens 35, 36. After a sheet 9 is cut and creased by the flat cutting and creasing die 87 on the lower surface of upper platen 35, platen 35, 36 separate and the cut blank 9 moves downstream between stripping platens 37, 38 which carry cooperating male and female stripping dies of a type well known to the art. During the interval of the rotary cycle for platens 37, 38 during which the latter are at the sheet feed path and have a substantial horizontal component of motion in the downstream direction, removal of scrap in the downward direction is accomplished through the interaction of the male and female stripping dies carried by platens 37, 38. In the alternative, stripping may be accomplished by a semi-orbiting lower stripping die (not shown) having a downstream end that oscillates at paper level and an upstream end that rotates with cutting platen 36.

After separation of platens 37, 38 following the stripping operation, sheet 9 continues downstream until it is engaged by fingers 42 of rotary separator 40 which sever the useful portion of the cut and creased sheet from the lead edge trim strip held by grippers 25. When this occurs, the cut and creased sheet is positioned above magazine 39 and falls to the top of delivery stack or pile 41. For those situations where lead edge trim is not provided, grippers 25 open in the vicinity of separator 40 and the fingers 42 of the latter deflect the entire sheet onto pile 41.

Lightweight horizontally oscillating slats 200 (only one of which is shown) disposed just below the plane of the horizontal sheet feed path are in inactive positions at the sides of the feed path when platens 35, 36 are engaged, and are pivoted to active positions just below the feed path as platens 35, 36 separate. In their active positions slats 200 support sheets 9 as they move between stations of press 10.

Figure 3:
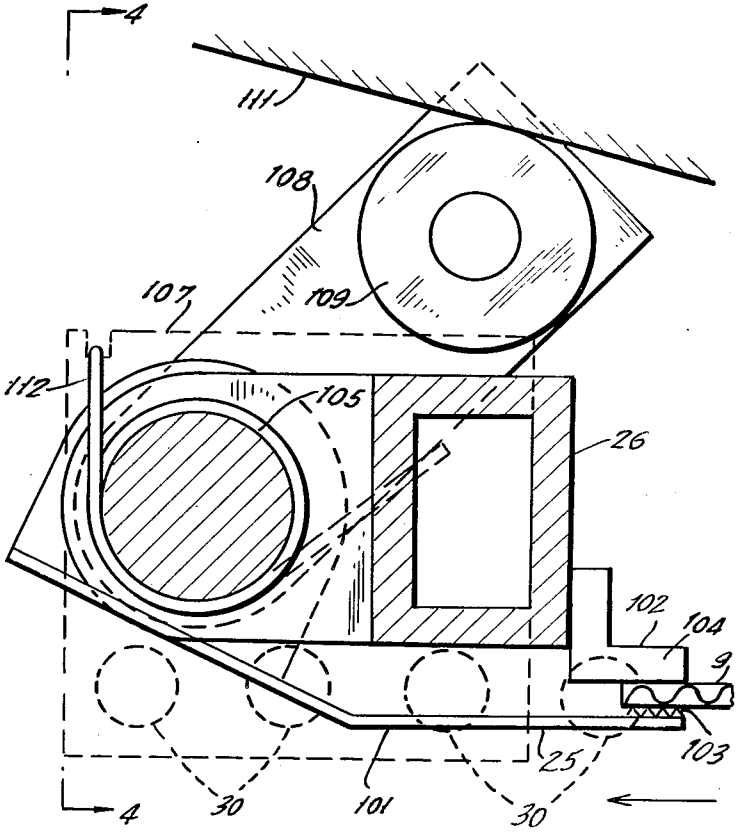
FIG. 3 is an enlarged end view of one of the feed slats.
Figure 4:
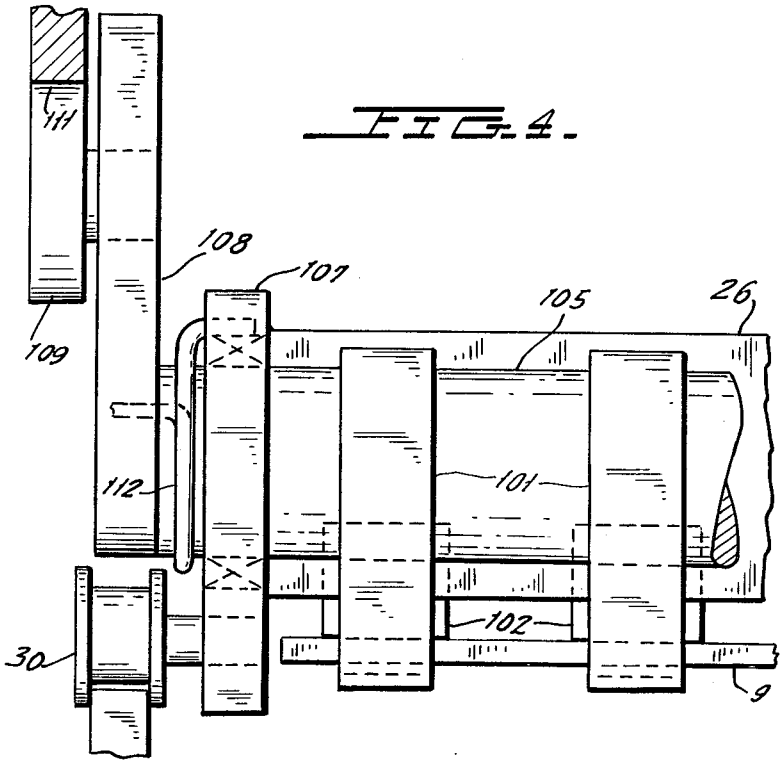
FIG. 4 is a partial elevation of the feed slat of FIG. 3, looking in the direction of arrows 4—4 of FIG. 3.

As seen best in FIGS. 3 and 4, each of the grippers 25 consists of movable jaw 101 and stationary pad 102. The downstream end of jaw 101 is secured to shaft 105 which extends parallel to hollow rectangular feed slat 26, and the free upstream end of jaw 101 is provided with teeth 103 which extend toward leg 104 of pad 102. The other leg of pad 102 is fixedly secured to feed slat 26 having each end thereof secured to an individual end plate 107 mounted directly on the sections of conveyor chain 30. End plates 107 also pivotally support shaft 105. Disposed outward of at least one end plate 107 and extending radially from shaft 105 is arm 108. Cam follower roller 109, rotatably mounted to arm 108 at the end thereof remote from shaft 105, is biased toward statioary cam surface 111 by U-shaped spring 112. In FIG. 3, spring 112 is seen as also providing the clamping force which holds the lead edge of sheet 9 between teeth 103 of jaw 101 and leg 104 of pad 102.

Stationary cam surface 111 is shaped and positioned so that as feed slat 26 reaches predetermined positions, the engagement between follower 109 and cam surface 111 forces shaft 105 to pivot clockwise with respect to FIG. 3, thereby moving teeth 103 away from pad 102. This situation prevails as feed slat 26 moves downward in the chain flight between sprockets 31 and 34 so that jaw 101 is fully opened as the leading edge of sheet 9 driven by rollers 22, 23 approaches chain 30. The shape of stationary cam surface 111 is such that jaw 101 remains fully open as feed slat 26 travels a short distance downstream of sprocket 31. Thus, movable jaw 101 will not interfere with infeeding of sheets 9. Prior to the time when the trailing edge of sheet 9 moves downstream of feed rollers 22, 23 follower 109 has reached a point along cam 111 where gripper 25 is in the closed position illustrated in FIG. 3. Gripper 25 remains closed until follower 109 engages another stationary cam section (not shown) in the vicinity of sprocket 33 where the lead edge trim strip is released. In the absence of lead edge trim, gripper 25 will be opened when the cut and trimmed sheet is over pile 41.

Thus, it is seen that conveyor chain 30 moves continuously at uniform speed, cutting platens 35, 36 and stripping platens 37, 38 have continuous motion and there is no need to slow conveyor chain 30 for delivery of sheets 9 to grippers 25 or to slow cutting platens 35, 36 or stripping platens 37, 38 while sheets 9 move between these platens or are operatively engaged by working elements carried by these platens. Even though there is a very slight differential speed between the horizontal motion of feed chain 30 and the downstream horizontal component of platen motion, for most sheet material and die cut configurations this differential speed need not be compensated for. In fact horizontal speed differential decreases to zero at the finish of the cut when platens 35, 36 are in their respective lowest and highest positions. If differential speed compensation is desired, a lost motion connection with spring biasing may be provided between feed slat mounting plates 107 and feed chain 30. A suitable type of lost motion connection is described in United Kingdom Patent Specification No. 1,038,890. In a practical construction embodying the instant invention, platen eccentricity is about a radius of approximately eight (8) inches and the die means engages the sheet for approximately 10° either side of the vertical, or the lowest position for the upper platen.

While the instant invention has been described in connection with translating in a circular path being imparted to both the upper and lower platens, it is noted that the platen carrying the flat anvil, usually the lower platen, may be reciprocated in a horizontal plane while the other platen carrying the cutting and creasing knives moves with the motion hereinbefore described. This general type of arrangement is seen in U.S. Pat. No. 3,653,304, issued Apr. 4, 1972 to F. Lenoir for "Apparatus for Cutting and Creasing Sheets."

Further, it should now be apparent to those skilled in the art that bottom support slats 200 for sheets traveling between stations may be provided by continuously rotating disks or rods (not shown). As an alternative to slats 200, pneumatic supports may be utilized.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A cutting and creasing press for sheet material including a frame, flat platen-type die means, eccentric shaft means rotatably mounted to said frame and said die means, closed loop conveyor means, sheet gripping means carried by said conveyor means and including sections equally spaced along the path of movement for the conveyor means, said conveyor means having a generally horizontal flight for carrying said gripping means in a feed direction along a generally horizontal feed path extending through a sheet loading station, a sheet unloading station, and a cutting station having said die means positioned thereat said die means having means for full cutting sheet material, said cutting station being positioned between said sheet loading and unloading stations, sheet feeding means for delivering sheets one at a time to said gripping means while the latter moves through said loading station, drive means operatively connected to said eccentric shaft means for rotating the latter at uniform cyclic speed to translate said die means along a circular path positioned for said die means to operatively engage and thereby full cut a sheet moving along said feed path through said cutting station, said drive means also being operatively connected to said conveyor means for moving the latter continuously at a uniform speed that coincides generally with a horizontal component of motion for said die means while the latter is engaged with a sheet moving along said feed path, and sheet support means disposed at said cutting station and means for moving said sheet support means between operative and retracted positions during operation of said drive means, said sheet support means when in said operative position supporting a sheet from below while the latter is not being cut.

2. A cutting and creasing press as set forth in claim 1 wherein said means for moving said support means retracting the latter from said operative position while a sheet is operatively engaged by said die means.

3. A cutting and creasing press as set forth in claim 2 also including a rotary lead edge trim separator disposed at said sheet unloading station in operative position to engage cut sheets and separate lead edge trim strips held by said sheet gripping means from remaining portions of said cut sheets.

4. A cutting and creasing press as set forth in claim 1 also including weight means driven by said eccentric shaft means to generate dynamic forces that counterbalance variable cyclic loading of said die means.

5. A cutting and creasing press as set forth in claim 1 in which there is a biasing means that urges the sheet gripping means toward a closed sheet gripping position; stationary cam means extending upstream from said sheet loading station; follower means operatively connected to said sheet gripping means and engageable with said cam means to maintain said sheet gripping means open while said sheet feeding means is delivering sheets to said gripping means.

6. A cutting and creasing press as set forth in claim 1 also including lead edge trim separator disposed at said sheet unloading station in operative position to engage cut sheets and separate lead edge trim strips held by said sheet gripping means from remaining portions of said cut sheets.

7. A cutting and creasing press as set forth in claim 6 in which the lead edge trim separator is a rotary device.

8. A cutting and creasing press as set forth in claim 1 in which there is a separator disposed at said sheet unloading station in operative position to engage cut sheets and positively separate them from said sheet gripping means.

9. A cutting and creasing press as set forth in claim 1 in which said feed path also extends through a stripping station located between said cutting station and said unloading station; stripping means disposed at said stripping station and operatively connected with said die means for coordinated operation therewith so that while a relatively upstream sheet is being cut by said die means a relatively downstream sheet is being stripped of waste sections by said stripping means.

10. A cutting and creasing press as set forth in claim 1 in which said die means includes opposed upper and lower platens disposed above and below the feed path, said eccentric shaft means extending transverse to said feed direction and including parallel first, second, third and fourth shafts rotated at identical speeds by said drive means; said first and second shafts being connected to said upper platen with said first shaft being upstream of said second shaft; said third and fourth shafts being connected to said lower platen with said third shaft being upstream of said fourth shaft; said eccentric shaft means also including first, second, third and fourth eccentric sections driven by the respective first, second, third and fourth shafts; said upper platen having upward extensions substantially inboard of the side edges of said upper platen, and said lower platen having downward extensions substantially inboard of the side edges of said lower platen; said first and second eccentric sections being rotatably mounted to said upward extensions and being operable to move said upper platen, and said third and fourth eccentric sections being rotatably mounted to said downward extensions and being operable to move said lower platens.

11. A cutting and creasing press as set forth in claim 10 also including an individual counterbalancing weight means keyed to each of said shafts.

12. A cutting and creasing press as set forth in claim 11 constructed with said counterbalancing weight means on said first and second shafts being disposed between transversely spaced sections of said upward extensions, and said counterbalancing weight means on said third and fourth shafts being disposed between transversely spaced sections of said downward extensions.

13. A cutting and creasing press as set forth in claim 12 wherein said support means being retracted from said operative position while a sheet is operatively engaged by said die means.

14. A cutting and creasing press as set forth in claim 12 in which there is a biasing means that urges the sheet gripping means toward a closed sheet gripping position; stationary cam means extending upstream from said sheet loading station; follower means operatively connected to said sheet gripping means and engageable with said cam means to maintain said sheet gripping means open while said sheet feeding means is delivering sheets to said gripping means.

15. A cutting and creasing press as set forth in claim 12 also including a rotary lead edge trim separator disposed at said sheet unloading station in operative position to engage cut sheets and separate lead edge trim strips held by said sheet gripping means from remaining portions of said cut sheets.

16. A cutting and creasing press as set forth in claim 10 also including means driven by said eccentric shaft means to generate dynamic forces that counterbalance variable cyclic loading of said die means.

17. A cutting and creasing press as set forth in claim 1 also including means driven by said eccentric shaft means to generate dynamic forces that counterbalance variable cyclic loading of said die means.

18. A cutting and creasing press as set forth in claim 1 in which there is a biasing means that urges the sheet gripping means toward a closed sheet gripping position; stationary cam means extending upstream from said sheet loading station; follower means operatively connected to said sheet gripping means and engageable with said cam means to maintain said sheet gripping means open while said sheet feeding means is delivering sheets to said gripping means.

19. A cutting and creasing press as set forth in claim 1 in which there is a separator disposed at said sheet unloading station in operative position to engage cut sheets and positively separate them from said sheet gripping means.

* * * * *